US009534371B2

(12) United States Patent
Judd

(10) Patent No.: US 9,534,371 B2
(45) Date of Patent: Jan. 3, 2017

(54) FRAMING SYSTEM FOR STEEL STUD FRAMING

(71) Applicant: Steven G. Judd, West Valley, UT (US)

(72) Inventor: Steven G. Judd, West Valley, UT (US)

( * ) Notice: Subject to any disclaimer, the term of this patent is extended or adjusted under 35 U.S.C. 154(b) by 0 days.

(21) Appl. No.: 13/833,564

(22) Filed: Mar. 15, 2013

(65) Prior Publication Data

US 2013/0255178 A1 Oct. 3, 2013

Related U.S. Application Data

(60) Provisional application No. 61/616,350, filed on Mar. 27, 2012.

(51) Int. Cl.
*E04B 1/344* (2006.01)
*E04B 2/58* (2006.01)
*E04B 1/24* (2006.01)

(52) U.S. Cl.
CPC ..... *E04B 1/344* (2013.01); *E04B 2/58* (2013.01); *E04B 2001/2415* (2013.01); *E04B 2001/2439* (2013.01); *E04B 2001/2448* (2013.01); *Y10T 403/32951* (2015.01)

(58) Field of Classification Search
CPC ..... E04B 2001/2415; E04B 2001/2439; E04B 1/344; E04B 2/58; E04C 2003/0473; Y10T 403/32951
USPC ..... 52/646, 645, 648.1, 71, 241, 481.2, 272,52/573.1, 479, 481.1; 403/2, 14, 231, 403
See application file for complete search history.

(56) References Cited

U.S. PATENT DOCUMENTS

| | | | | | |
|---|---|---|---|---|---|
| 689,894 | A * | 12/1901 | Lutz | 285/184 | |
| 1,170,188 | A * | 2/1916 | Brown | 135/149 | |
| 3,111,202 | A * | 11/1963 | Costello | 52/645 | |
| 5,467,566 | A * | 11/1995 | Swartz | E04B 2/96 | 52/235 |
| 5,577,860 | A * | 11/1996 | Plank | 403/403 | |
| 5,720,571 | A * | 2/1998 | Frobosilo et al. | 403/403 | |
| 5,735,100 | A * | 4/1998 | Campbell | 52/645 | |
| 6,000,181 | A * | 12/1999 | Wheeler | 52/241 | |
| 6,213,679 | B1 * | 4/2001 | Frobosilo et al. | 403/403 | |
| 6,434,908 | B1 * | 8/2002 | Ferrante | 52/481.2 | |
| 6,637,173 | B1 * | 10/2003 | Wheeler | 52/745.12 | |
| 6,929,227 | B2 * | 8/2005 | Hofmann | F16B 3/06 | 248/224.8 |
| 7,073,299 | B1 * | 7/2006 | diGirolamo et al. | 52/241 | |
| 7,159,365 | B2 * | 1/2007 | Cohen | 52/245 | |
| 7,293,392 | B2 * | 11/2007 | Krumbacher | 52/241 | |
| 7,478,508 | B2 * | 1/2009 | Peterson | 52/573.1 | |
| 7,918,054 | B2 * | 4/2011 | Grafton et al. | 52/92.3 | |
| 2002/0062617 | A1 * | 5/2002 | diGirolamo et al. | 52/688 | |
| 2008/0216425 | A1 * | 9/2008 | Moscovitch | 52/255 | |

* cited by examiner

*Primary Examiner* — Babajide Demuren
(74) *Attorney, Agent, or Firm* — Geoffrey E. Dobbin; Dobbin IP Law P.C.

(57) ABSTRACT

The present invention is a framing system for resolving vertical and horizontal movements in light gage, cold formed, steel stud framing. It utilizes at least one corner hinge and a plurality of pivoting stud clips (one for each stud) that accommodate for the deflection of a building as it encounters environmental changes. Additional hinges may be placed axially, along the wall and at the top and bottom of the corner for increased flexibility. Two embodiments of stud pivot clips, one utilizing direct attachment and arcuate slots, the other utilizing a pivotable connection plate, are disclosed; as are two hinge embodiments.

11 Claims, 7 Drawing Sheets

FRAMING SYSTEM FOR STEEL STUD FRAMING

CROSS-REFERENCES TO RELATED APPLICATIONS

This Application claims priority to prior filed U.S. Provisional Application No. 61/616,350, filed Mar. 27, 2012 and incorporates the same by reference herein in its entirety.

FIELD OF THE INVENTION

The present invention relates to the field of building construction and more particularly relates to a structural framing system for accommodating building movements.

BACKGROUND OF THE INVENTION

The current 2012 International Building Code and most prior model building codes used in the United States (UBC, SBC, BOCA) dating back at least as far as 1972 have required non-structural building enclosures (aka: "facades", "building skins", "cladding") to be designed to accommodate building movements. Said movements include, but are not limited to, vertical displacements of perimeter framing members (spandrel beams) caused by the application of live and other superimposed gravity loads, and the horizontal building movements of the primary structural Lateral Force Resisting System(s) (LFRS) caused by wind, seismic, and other lateral forces. There are many ways to resolve both vertical and lateral movements in light gage, cold formed, steel stud framing (LGCFSSF), in the field of the wall (along a straight run of wall away from building corners) via nested tracks, slotted tracks, slide clips, and several other mechanisms that are currently in the marketplace. These current methods and systems leave accommodation of lateral movements at the corner areas of buildings largely unresolved. Most current framing details and connection systems for LGCFSSF do not specifically address the unique conditions at building corners. Most current LGCFSSFSs require/assume some level of distress and/or failure of the enclosure system at building corners, have extremely large visible joints (to separate the two adjacent walls meeting at the building corner to avoid contact), or include a system that requires the use of a horizontal slotted bent metal angle and special finish materials other than the typical cladding material and at the corner: a special material that can undergo traction and contraction forces. Depending on the magnitude of the lateral forces and the lateral stiffness of the building, said building corners may undergo extreme distress and even member failures due to the bi-directional attitude of building movement at corners; lateral movement in two orthogonal planes intersecting at the corner. Alternatively large joints are needed—joints in the order of 3" to 6" in some cases. This current state of the art is the reason for the need for a better resolution of enclosure wall performance at building corners.

The present invention is a framing system that incorporates hinges and pivot capable stud clips in an effort to form corners that are easily assembled without large joints and simultaneously deformable according to the majority of current model codes.

SUMMARY OF THE INVENTION

In view of the foregoing disadvantages inherent in the known types of framing systems for steel stud framing, this invention provides an improved system which accommodates for deformable corners in the eventual facade of the finished construction. As such, the present invention's general purpose is to provide a new and improved framing system that utilizes vertical, pivoting studs, horizontal header-struts (top and bottom tracks), selectively placed pre-fabricated/pre-manufactured horizontal-plane rotational hinges in the top and bottom track, and pre-fabricated/pre-manufactured vertical-plane rotational stud clips, or "pivot clips." The pivot clips secure the studs to the edge of floor and allow the studs to rotate freely as driven by story drift displacements. The framing assembly accommodates building movements at building corners through controlled non-planar deformation of the corner region of the building. When properly designed and installed, the framing system disclosed herein significantly mitigates distress at building corners, in some cases, and completely eliminates distress in most cases. The disclosed framing system provides for smaller visible joints in exterior enclosures and allows the use of the typical cladding material without the introduction of other finish materials at the building corner. Critical to the system are the special slab edge vertical plane rotational clips and the horizontal plane hinges in the top and bottom tracks, both of the aforementioned components being ideally pre-fabricated or pre-manufactured and are disclosed herein in two different preferred embodiments each.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
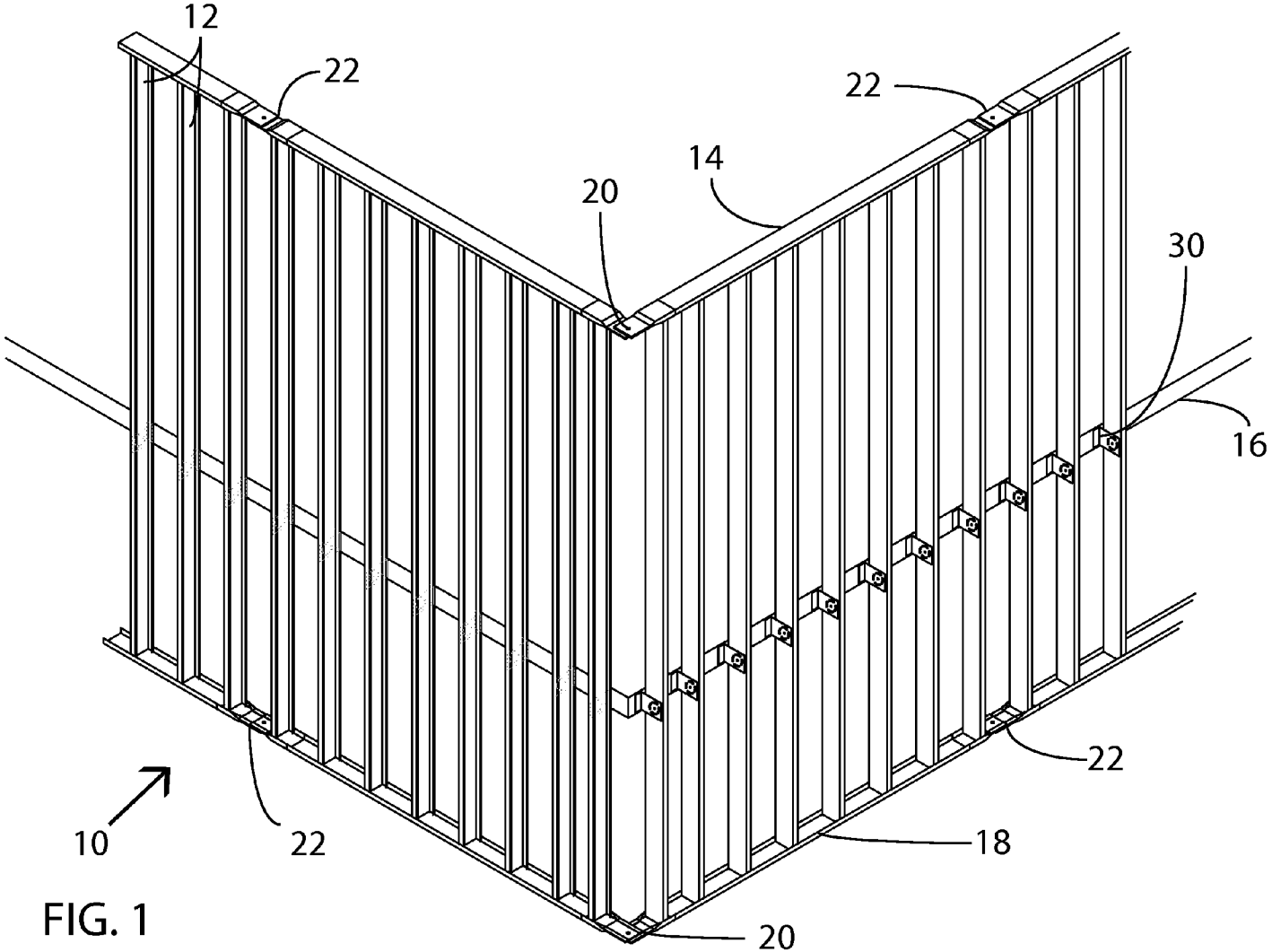
FIG. 1 is a perspective view of a wall frame on an elevated floor utilizing the present invention.
Figure 2:
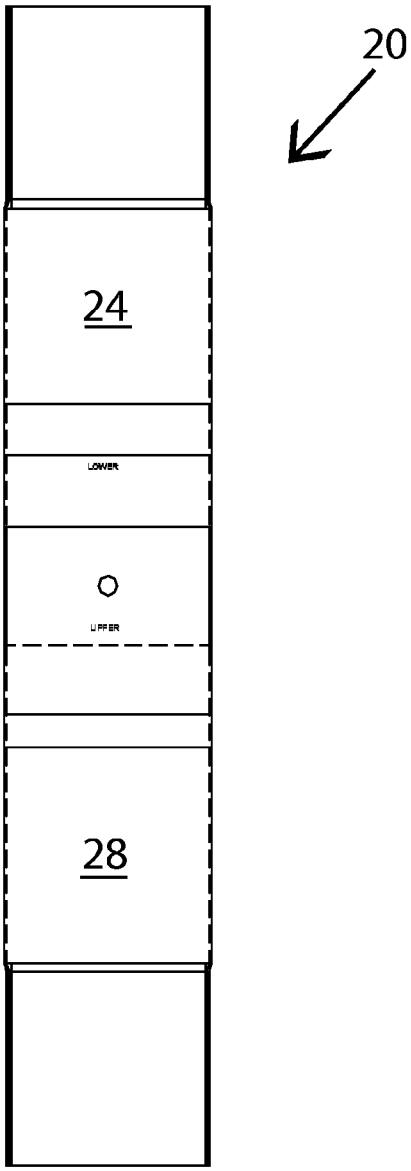
FIG. 2 is a top plan view of a hinge utilized in the present invention.
Figure 3:
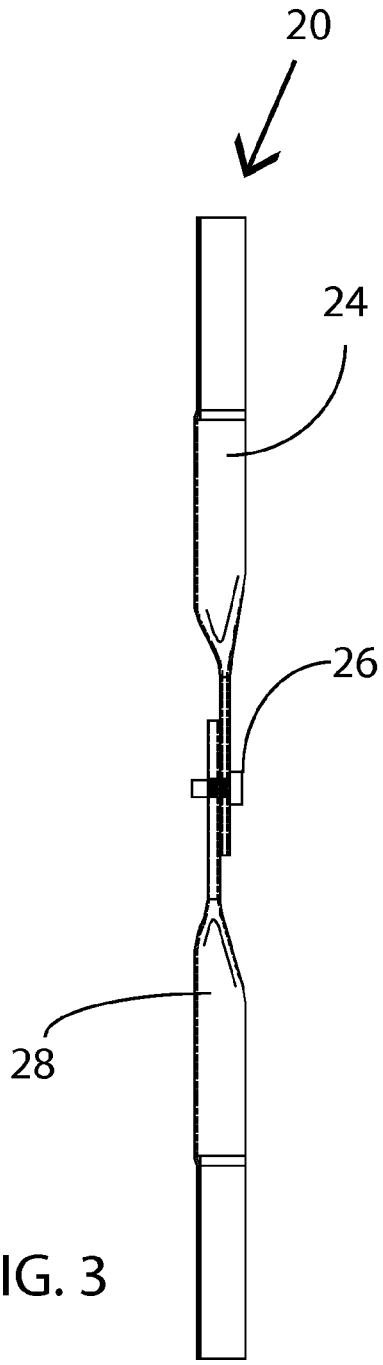
FIG. 3 is a side elevation of the hinge of FIG. 2.
Figure 4:
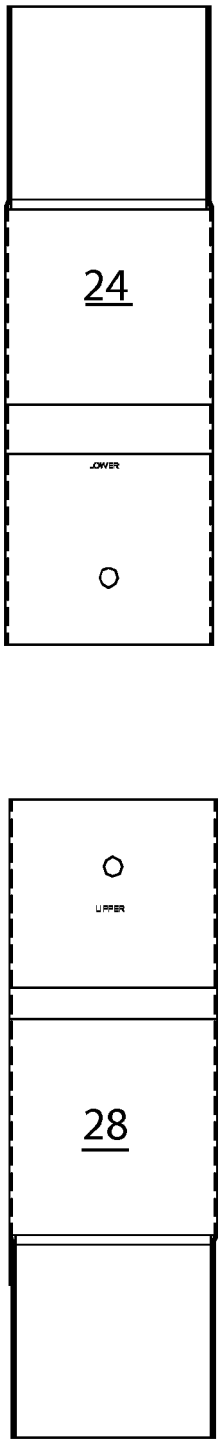
FIG. 4 is an exploded view of the hinge of FIG. 2.

With reference now to the drawings, the preferred embodiment of the framing system is herein described. It should be noted that the articles "a", "an", and "the", as used in this specification, include plural referents unless the content clearly dictates otherwise. The following reference numbers are used in this specification to identify the following parts of the invention:

10—framing system
12—framing stud
14—upper strut track
16—floor slab
18—lower strut track
20—corner rotational hinge
22—axial rotational hinge
24—lower hinge half
26—hinge pivot pin
28—upper hinge half
30—stud clip
32—clip arcuate slot
34—clip center hole
40—alternate hinge
42—alternate hinge tongue
43—alternate hinge tongue with a bend
44—alternate hinge saddle
46—alternate hinge channel section
48—pivot element
50—alternate stud clip
52—fastening plate
54—plate attachment holes
56—pivot element
58—L-bracket With reference to FIG. 1, the exemplar framing system 10 is an assemblage of a plurality of light gage, cold formed, steel studs 12, steel girt-strut tracks 14, 18, special pre-manufactured vertical plane rotational stud clips 30 and pre-manufactured horizontal-plane rotational hinges 20, 22. The system is intended for applications where steel stud framing is utilized to enclose a building and where said framing extends past the edge of the floor slab 16 (on elevated floors), and is supported independently at each floor—sometimes called "by-pass" framing. Although intended for "by-pass" framing, the system can also be applied to single story or bottom story framing that rests on the ground. The system is generally limited to a region from 5 feet to 8 feet from the building corner on each side of the building corner, but may, upon proper design and detailing, be of different dimensions.

In the region of the system studs are attached to the edge of the floor slab 16 with vertical-plane stud pivot clips 30, the studs extend below the floor to some predetermined elevation (normally the elevation of the head of the window below the floor) and extend up to a similar relative elevation above the floor to which they are attached. Girt-strut track elements 14, 18 run along the top and bottom of the studs, tying the studs 12 together and preventing rotation of the studs 12 about their vertical axis (twisting). A gap is provided between the bottom of the system at one floor and the top of the system at the floor below to allow for vertical deflections of the building framing and other movements. No mechanical tie or link is provided, needed, or allowed between the corner framed system from floor to floor within the area between the horizontal plane hinges 22 and the building corner. A horizontal-plane hinge 20 is placed in the top girt-strut track 14 (and sometimes in the bottom girt-strut track 18) at the intersecting corner of the building—called the "corner hinge". Other horizontal plane hinges 22 are placed in the top track (and sometimes the bottom track) at the ends of the area that undergoes non-planar deformation away from the corner—called "axial hinges"—at one or both sides of the corner, depending on the building configuration. The far end of the axial hinge 22 connects to the typical framing system which continues along the wall away from the corner framing—preferably a nested track system. Vertical dynamic sealant joints are provided in the exterior finish system at locations aligned with or near a vertical line associated with the corner-hinge 20 and axial-hinges 22.

How it Functions:

As the building moves laterally, perpendicular to the face of the exterior wall, the framing in the field of the wall (framing beyond the corner framing system) will (should) tilt in and out of plane as driven by the lateral movement of the building. The stud pivot clips 30 allow for this stud rotation. The axial hinge 22 at the far end of the corner framing system will link the corner framing system to the field framing. The corner framing system will ride along with the field framing at the axial hinge 22, moving the far end of the top girt-strut track 14 with it. The top girt-strut track 14 will gradually transition to the quasi-static corner position at the corner hinge 20 where the studs 12 remain essentially vertical. At the building corner, the perpendicular wall will keep the building corner in vertical alignment, so the wall element adjacent to the tilting field framing will be driven into a non-planar shape (a hyperbolic-paraboloid shape). There is no connection in the corner framed system from floor to floor so no loads are transmitted from floor to floor within the corner framed system. An offset condition will occur when the building displaces. As the building moves laterally, parallel to the face of the building, the field framing will slip along its axis at the top of the wall in the deflection track. Since there is no connection between floors in the system, the corner will simply displace creating an offset (temporary) until the building rights itself.

For optimum performance of the corner framed system, the length of the sides of the corner framed system are based on the amount of story drift intrinsic to the building and the type of finish materials applied to the stud framing, varying from around 5 feet to upwards of 10 to 12 feet.

The top girt-strut track 14, carries an axial load delivered through the corner hinge 20 from the perpendicular forces on the adjacent wall and delivers it through the axial hinge 22 to the wall beyond the corner framed systems, or delivers it to diagonal bracing within the corner framed system (not shown).

Joint sizing is based on many factors including: the distance from face of stud framing to face of finish material, specified thermal gradients, magnitude of lateral building movement at each floor, sealant movement potential, length of the system side elements, and other factors.

Figure 6:
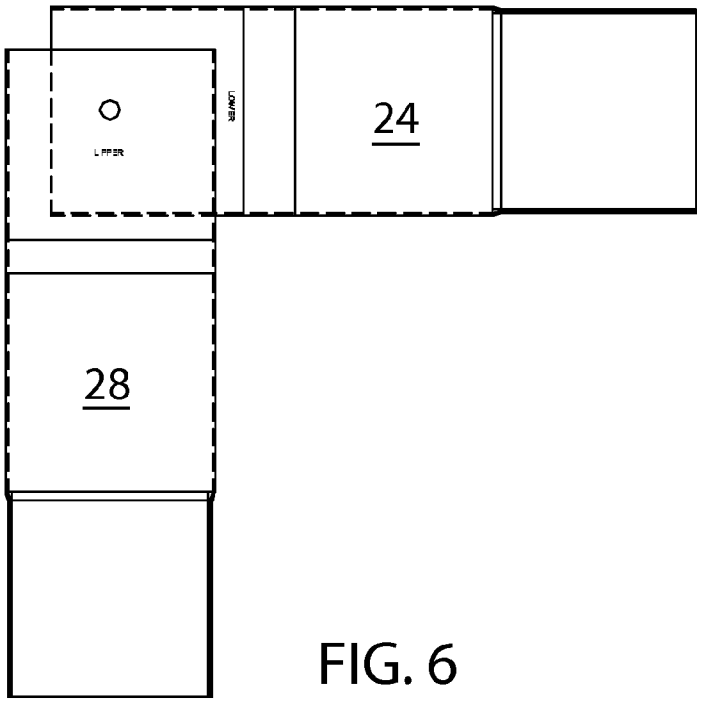
FIG. 6 is a top plan view of the hinge of FIG. 2, rotated to a right angle.
Figure 5:
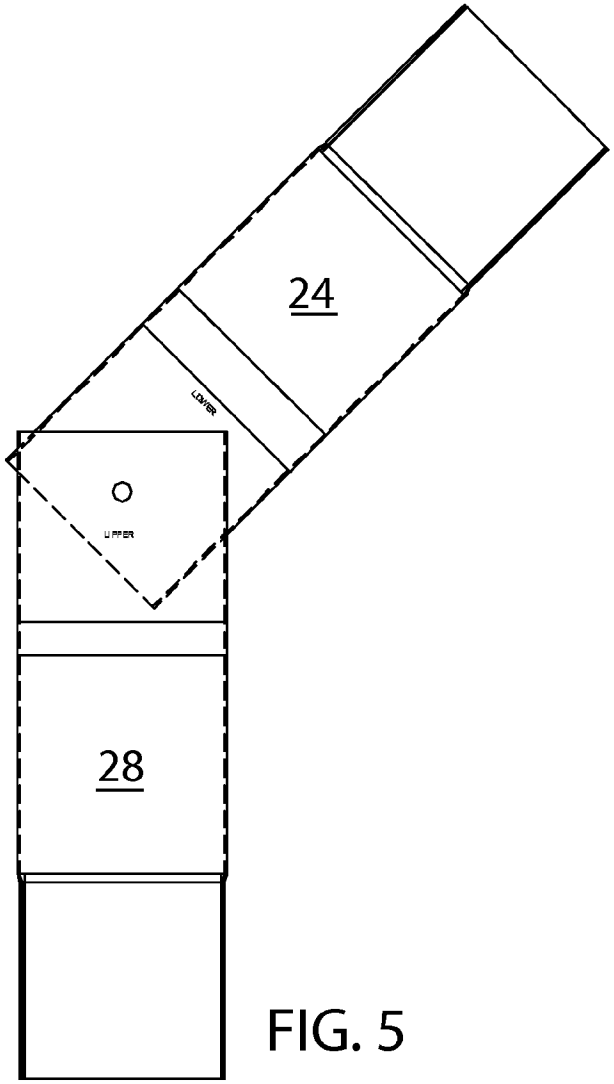
FIG. 5 is a top plan view of the hinge of FIG. 2, rotated to an angle.
Figure 7:
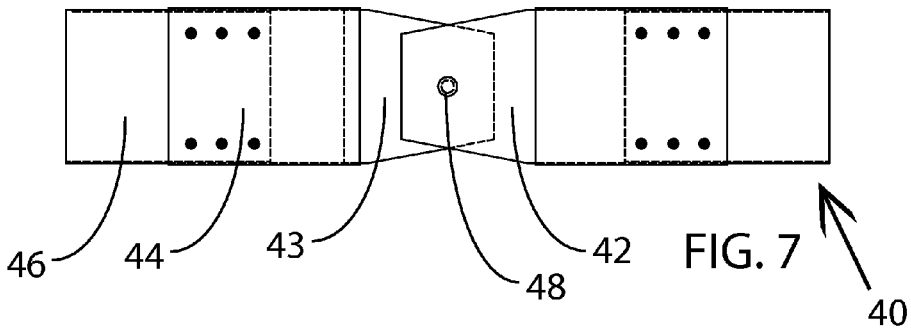
FIG. 7 is a top plan view of an alternate hinge utilized in the present invention.
Figure 8:
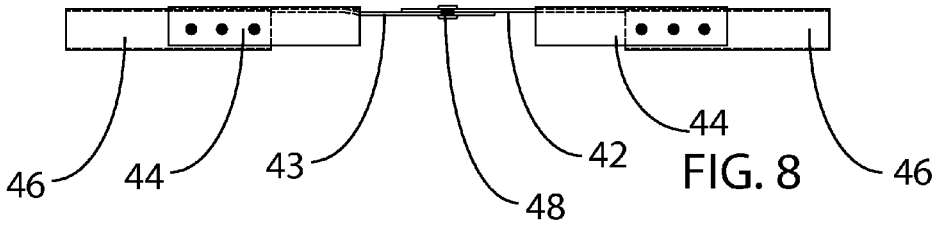
FIG. 8 is a front elevation of the alternate hinge of FIG. 7.
Figure 9:
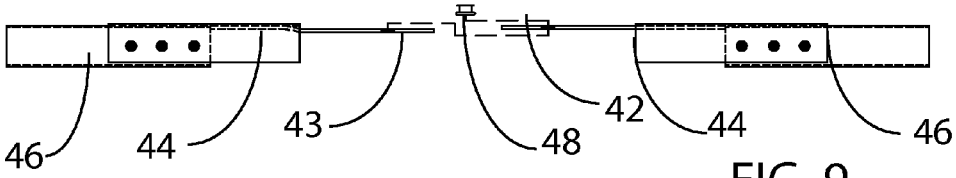
FIG. 9 is an exploded view of the alternate hinge of FIG. 8
Figure 10:
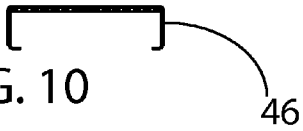
FIG. 10 is a side elevation of the alternate hinge of FIG. 7.
Figure 11:
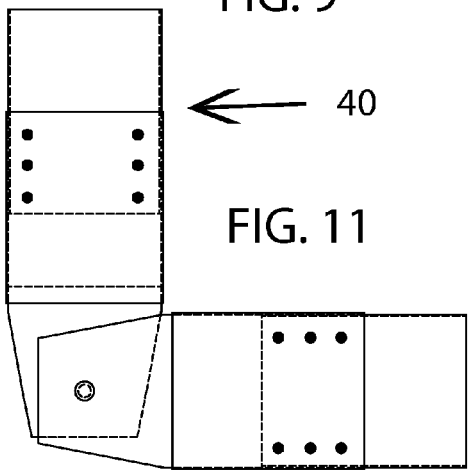
FIG. 11 is a top plan view of the hinge of FIG. 7, in a corner hinge configuration.
Figure 12:
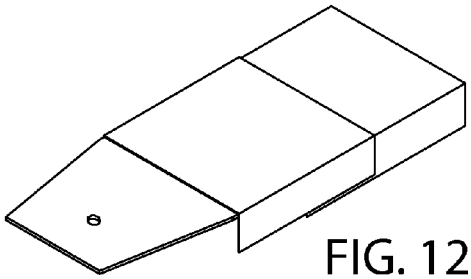
FIG. 12 is a perspective view of one half of the alternate hinge of FIG. 7.

The individual, unique components of the system are shown in FIGS. 2-10. FIGS. 2-6 depict a hinge, either axial 22 or corner 20. A first embodiment of each hinge 20 is formed from upper 28 and lower 24 halves pivotably joined by pivot pin 26. Each features a tongue and bodies that are off-set with respect to each other so to accommodate sliding into position with a track 14, 18. As seen in FIGS. 5 and 6, the two hinge halves 24, 28 rotate to any angle about the pivot pin 26, thus accommodating for any angle of corner (including the wall at 300° in the case of the axial hinge 22 and for deflection of the corner, which may deflect between 3° and 5°. In use the hinges are intended to be at least a semi-permanent attachment to the struts 18, 14. Hinges 20 and struts 18, 14 may be attached by bolts, screws or other suitable fasteners, including self-drilling, self-tapping screws. They may also be permanently joined by welding or some other method.

An alternate hinge assembly 40 is depicted in FIGS. 7-16. This hinge is constructed of two halves (FIGS. 12-13), each made of three parts, a tongue 42, 43, a connecting saddle 44, and a channel section 46. The three parts may be fashioned together or assembled by any means known or later discovered; such as by spot welding them together. The two halves are joined by a pivot element 48 which, like the previous embodiment, may be a pin, bushing, rivet, grommet, or any other suitable connection piece that allows for pivoting motion between the halves. The hinges may be made in halves, such that they may be assembled as corner or axial hinges as needed on site, or may be pre-manufactured as one or the other. The two halves may be differentiated by their tongues, as one tongue 42 (FIG. 12) is flat while the other 43 (FIG. 14) has a slight bend so as to accommodate the other tongue 42. It should be noted that the particular design of the tongues may allow for total rotation of the hinge halves or may be constructed to limit rotation, as is depicted. The depicted tongues 42,43 limit rotation of the hinges such that in the axial hinge shown in FIGS. 7-10 the hinge may rotate about 110°, however the corner hinge (FIG. 11) it limited to a range of rotation of about 10°. It should be noted that flection of the wall assembly due to story drift displacement is generally limited to 3-5° before such flection usually proves catastrophic, even if the methods and structures of the present invention are followed.

Figure 15:
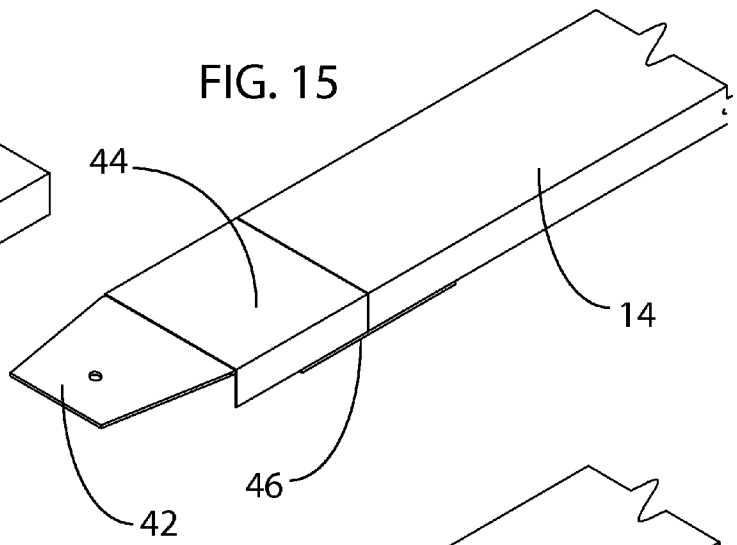
FIG. 15 is a perspective view of the hinge half of FIG. 12 inserted in an upper strut track.
Figure 13:
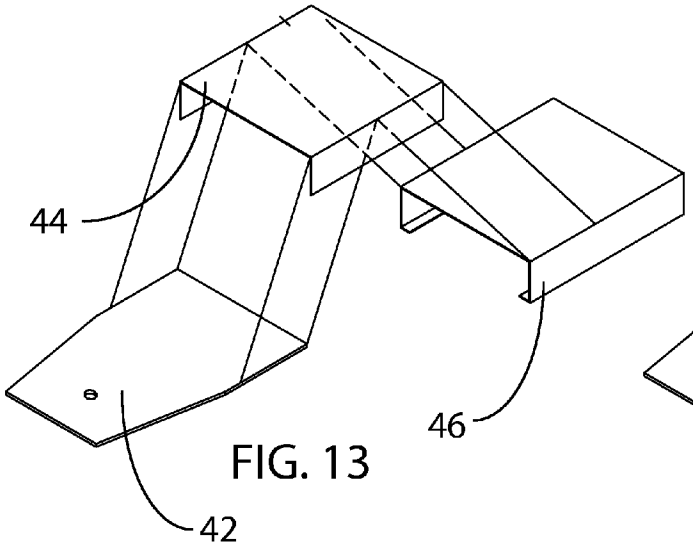
FIG. 13 is an exploded view of the hinge half of FIG. 12.
Figure 16:
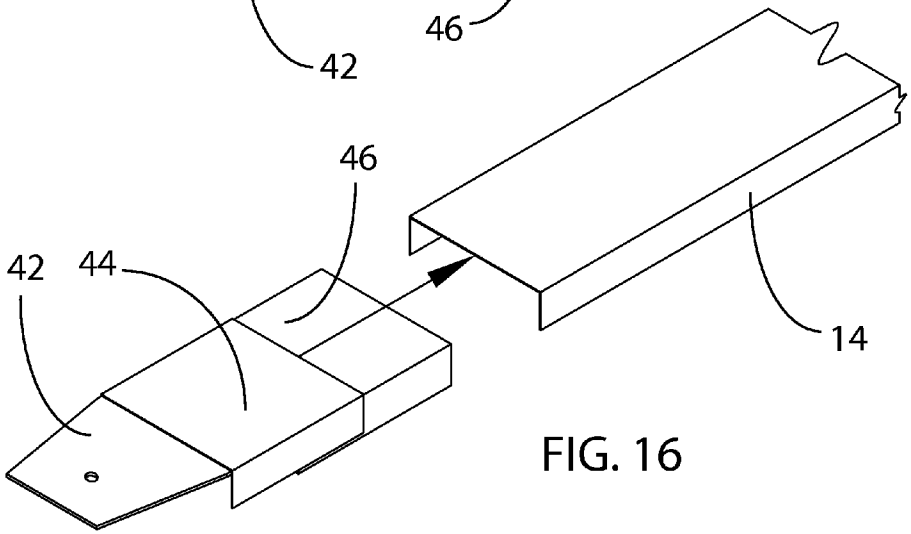
FIG. 16 is an exploded view of the hinge and track assembly of FIG. 15.
Figure 14:
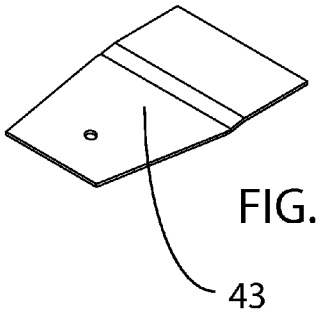
FIG. 14 is a perspective view of a bent tongue used in the alternate hinge of FIG. 7.
Figure 17:
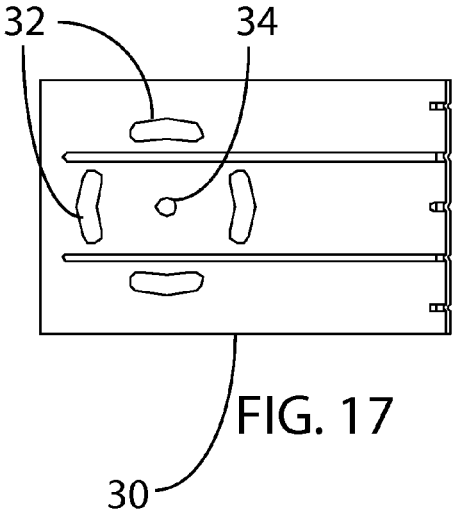
FIG. 17 is a front elevation of a stud clip utilized in the present invention.
Figure 18:
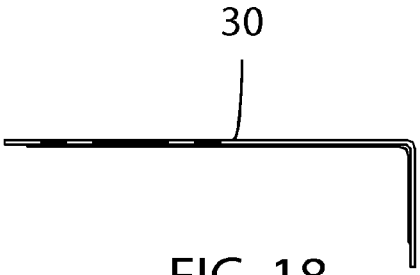
FIG. 18 is a side elevation of the stud clip of FIG. 17.
Figure 19:
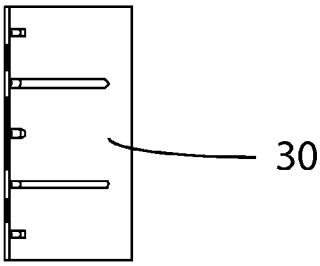
FIG. 19 is a top plan view of the stud clip of FIG. 17.
Figure 20:
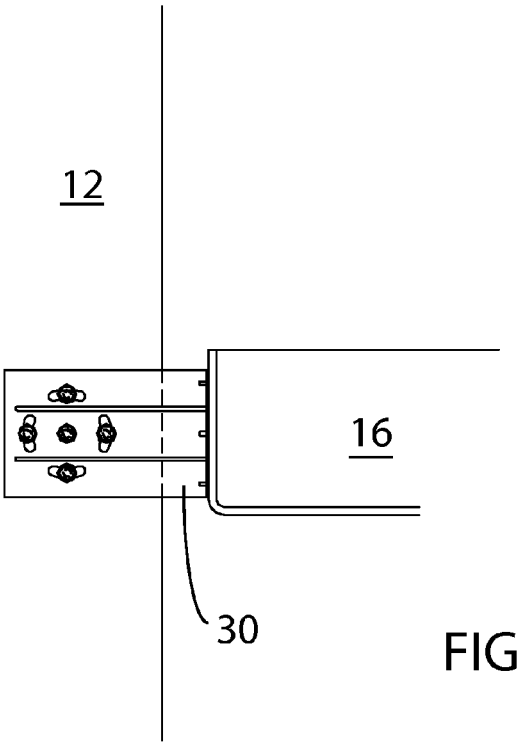
FIG. 20 is a front elevation of the stud clip of FIG. 17 in its installed position proximate a floor slab edge.
Figure 21:
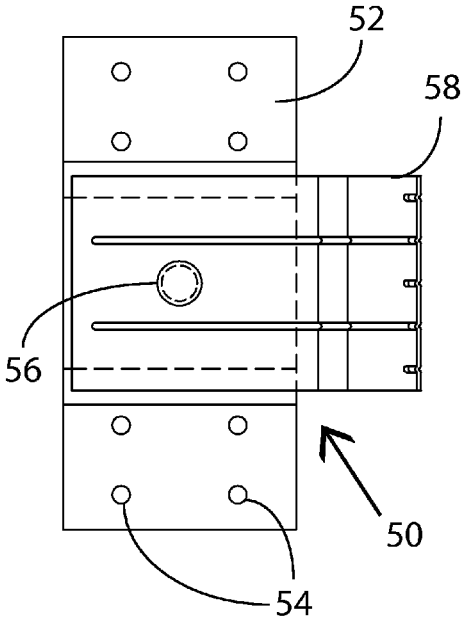
FIG. 21 is a front elevation of an alternate embodiment of a stud pivot clip utilized in the present invention.
Figure 22:
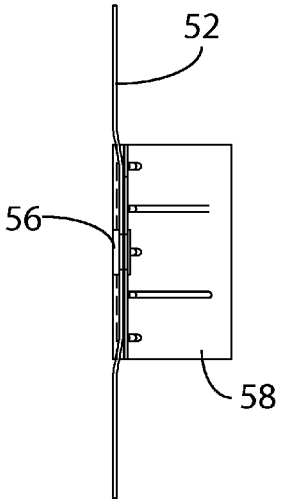
FIG. 22 is a side elevation of the stud pivot clip of FIG. 21.
Figure 23:
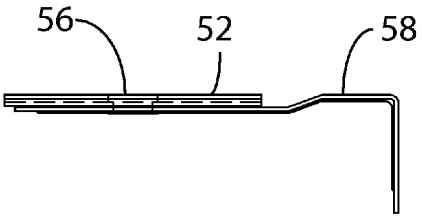
FIG. 23 is a top plan view of the stud pivot clip of FIG. 21.
Figure 24:
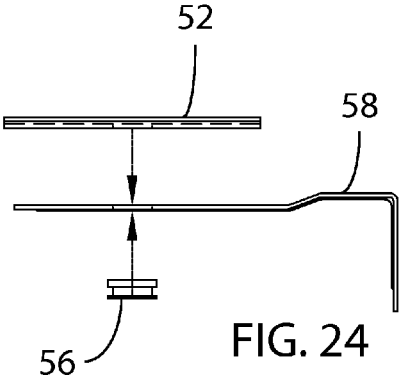
FIG. 24 is an exploded view of the stud pivot clip of FIG. 23.

Therefore allowing up to 10° or even 110° of rotation by the hinges is more than adequate to accommodate the usual displacement that may be encountered. In practice, the channel section 46 is flanged (FIG. 10) and is inserted into the girt-strut track 14 of a frame and they are mutually secured together (FIGS. 15-16).

FIGS. 17-20 depict a first embodiment of a stud pivot clip 30. The clip 30 is generally an "L" bracket with a plurality of holes on the long side. The holes include a central pivot hole 34 and at least 4 arcuate slots 32 which are attached to the individual studs 12. Stiffening ribs may also be provided as shown. In the figures, the arcuate slots 32 are depicted as being in the same circle, having the same distance (radius) to the central pivot hole 34. However, individual arcuate slots 32 may be in separate, concentric, circles with different radii about the central pivot hole 34. Any screw with sufficient shoulder or other means which allows rotational movement between clip and stud may be used to secure the pivot clip 30 to the stud 12.

In an alternate embodiment, shown in FIGS. 21-24, the stud pivot clip 50 is a two-piece construction joined at a pivot, thereby eliminating the need for the arcuate slots 32 or central pivot hole 34 of the previous embodiment. A fastening plate 52 is used as a base for the stud pivot clip 50 and may be welded to an individual stud or bolted thereto using the provided holes 54. An L-bracket 58, similar to the first described embodiment is joined to the floor slab 16 and the two pieces are joined by a pivot element 56, which may be a bushing, grommet or some other pivoting structure added or built into the fastening plate 52 and L-bracket 58. It should be noted that fastening plate 52 and L-bracket 58 are slightly bent to provide an off-set to accommodate the pivot element 56 and relative rotation. Like the previous embodiment, ribs or other deformations may be provided to strengthen the L-bracket 58.

Although the present invention has been described with reference to preferred embodiments, numerous modifications and variations can be made and still the result will come within the scope of the invention. No limitation with respect to the specific embodiments disclosed herein is intended or should be inferred.

The top and bottom girt-strut elements may be comprised of a single light gage cold-formed track profile or may be comprised of an assembly or other combinations of tracks, studs, cold-formed brake shapes, or hot-rolled shapes. The pre-fabricated/pre-manufactured pivot and hinge elements can be made by bending, stamping, forging, forming, casting, welding, and/or other suitable fabrication methods, or combinations thereof. The stud pivot clip may have additional features that enhance durability and strength, such as the illustrated ribs, or any other known or later discovered method or structure in the art, such as structural flanges.

What is claimed is:

1. A framing system for metal frame construction buildings, the system comprising:

a. a plurality of horizontal top girt-strut tracks;

b. a plurality of horizontal bottom girt-strut tracks, parallel to the top horizontal girt-strut tracks;

c. a plurality of studs, positioned in between the top and bottom girt-strut tracks and roughly orthogonal thereto;

d. a plurality of stud pivot clips, each stud pivot clip further comprising:

i. a backing plate;

ii. a generally L-shaped bracket; and iii. a pivot structure joining the backing plate and one leg of the L-shaped bracket;

e. at least one moveable corner hinge, joining two top girt-strut tracks together at an angle, thereby forming a corner wherein one of each stud pivot clip is positioned upon one of the plurality of studs such that each stud pivot clip is incapable of vertical and lateral displacement in relation to each stud upon which each stud pivot clips is attached and the pivoting structure of the stud pivot clips is located proximate a central longitudinal axis of the backing plate and allows for each stud to pivot with respect to each L-shaped bracket while simultaneously supporting and restraining vertical and lateral loads when the backing plate of the stud pivot clip is attached to a given stud and another leg of the generally L-shaped bracket is rigidly attached to a substrate, as a connecting plate, and the at least one corner hinge maintains its ability to rotate and transfer axial loads to and from the girt-strut track after the framing system is finalized in a construction.

2. The framing system of claim 1, further comprising at least one additional corner hinge, which maintains its ability to rotate after the framing system is finalized in a construction, joining two bottom girt-strut tracks struts in a manner complimentary to the at least one corner hinge joining the top girt-strut tracks.

3. The framing system of claim 2, further comprising at least one axial hinge, which maintains its ability to rotate after the framing system is finalized in a construction, joining adjacent top girt-strut tracks.

4. The framing system of claim 3, further comprising at least one axial hinge, which maintains its ability to rotate after the framing system is finalized in a construction, joining adjacent bottom girt-strut tracks.

5. The framing system of claim 1, further comprising at least one axial hinge, which maintains its ability to rotate after the framing system is finalized in a construction, joining adjacent top horizontal girt-strut tracks.

6. A corner construction for a framing structure of metal frame construction buildings, the framing structure comprising two horizontal top girt-strut tracks and two horizontal bottom girt-strut tracks with one top girt-strut track in a generally parallel relationship over one bottom girt-strut track and each of the four girt-strut tracks abutting the corner construction, the corner construction comprising:

a. two horizontal top girt-strut tracks;

b. two horizontal bottom girt-strut tracks, parallel to the top horizontal girt-strut tracks;

c. a plurality of studs, positioned in between the top and bottom girt-strut tracks and roughly orthogonal thereto; and d. one rotatable corner hinge, the corner hinge further comprising:

i. two hinge elements, each with two opposed ends, one end being a tongue and its opposite end being a channel section, and ii. a pivot element;

wherein the tongues of the two hinge elements are affixed together by the pivot element to form said corner hinge and the corner hinge is then directly joined to the two top girt-strut tracks by the channel sections of the hinge elements, thereby forming a corner with the two top girt-strut tracks.

7. The corner construction of claim 6, further comprising one additional rotatable corner hinge of the same construction as the one rotatable corner hinge directly joined to the two bottom girt-strut tracks in a manner complimentary to the rotatable corner hinge joining the top girt-strut tracks.

8. The corner construction of claim 7, further comprising at least one axial hinge, of the same construction as the rotatable corner hinges, joining a top girt-strut track of framing structure and one of the two top horizontal girt-strut tracks of the corner.

9. The corner construction of claim 7, further comprising a plurality of axial hinges, of the same construction as the corner hinges, each joining a single girt-strut track of the corner construction to an abutting girt-strut track of the framing structure.

10. The corner construction of claim 6, further comprising at least one axial hinge, of the same construction as the rotatable corner hinge, joining a top girt-strut track of the framing structure and one of the two top horizontal girt-strut tracks of the corner.

11. The corner construction of claim 6, further comprising a plurality of axial hinges, of the same construction as the rotatable corner hinge, each joining a single girt-strut track of the corner construction to an abutting girt-strut track of the framing structure.

* * * * *